US005752125A

United States Patent [19]

Yamashita et al.

[11] Patent Number: 5,752,125

[45] Date of Patent: May 12, 1998

[54] MAINTENANCE MANAGEMENT SYSTEM FOR IMAGE FORMING EQUIPMENT

[75] Inventors: Yuji Yamashita; Jiro Nagira; Yasuhiro Hashimoto; Hiroshige Utatsu, all of Osaka, Japan

[73] Assignee: Mita Industries Co. Ltd. Osaka, Japan

[21] Appl. No.: 716,888

[22] Filed: Sep. 20, 1996

[30] Foreign Application Priority Data

Sep. 28, 1995 [JP] Japan ..... 7-251376

[51] Int. Cl.[6] ..... G03G 15/00

[52] U.S. Cl. ..... 399/8; 399/24

[58] Field of Search ..... 399/8, 11, 24–27, 399/31, 126; 377/15, 16; 395/184.01

[56] References Cited

U.S. PATENT DOCUMENTS

| | | | |
|---|---|---|---|
| 5,016,059 | 5/1991 | Smeiman | 399/80 |
| 5,077,582 | 12/1991 | Kravette et al. | 399/8 |
| 5,200,779 | 4/1993 | Nawata | 399/24 |
| 5,343,276 | 8/1994 | Yamashita et al. | 399/8 |
| 5,369,471 | 11/1994 | Yamada | 399/8 |
| 5,386,271 | 1/1995 | Maekawa et al. | 399/8 |
| 5,596,390 | 1/1997 | Sawada | 399/8 |

FOREIGN PATENT DOCUMENTS 1-271767 10/1989 Japan .

*Primary Examiner*—Robert Beatty

*Attorney, Agent, or Firm*—Beveridge, DeGrandi, Weilacher & Young, LLP

[57] ABSTRACT

In a maintenance management system in which communications control devices of electronic photocopiers are connected through public telephone lines or the like with a host computer of a maintenance company that manages the photocopiers, preventive-maintenance-oriented, omission-free instructions for maintenance work are obtained by determining items of work to be performed based on how many times maintenance has been performed or based on a count of copies produced. For example, in the case where maintenance work to be performed on a first occasion includes items of work belonging to a work item setting area of a second order of precedence within a maintenance table, if items of work that need to be performed do not agree with those specified in the table, items of work of a first order of precedence are added. To achieve this, based on a count at a moment, a work item setting area in the maintenance table is judged to determine its array number, a maintenance state flag is judged, and the array number is incremented by one, so that instructions of the second order of precedence are indicated. Then, the array number of the area is decremented by one, and the flag is judged to be OFF, so that items of work of first order are added to those of the second order. Next, duplicated items within the same area are deleted, whether replacement is necessary or not is judged, and then it is determined that maintenance on the next occasion includes items of work of the first and second orders of precedence.

4 Claims, 13 Drawing Sheets

40

MAINTENANCE WORK ITEMS

| COMPONENT \ ARRAY NO. | 1 | 2 | 3 | 4 |
|---|---|---|---|---|
| | 0~50000~100000 | 100001~150000 | 150001~200000 | 200001~250000 |
| PAPER FEED CLUTCH | CLEANING | LUBRICATION | ADJUSTMENT | REPLACEMENT |
| PAPER FEED ROLLER | CLEANING | CLEANING | REPLACEMENT | < < < < |
| | | | | |

FIG. 7A

MAINTENANCE STATE FLAGS

| COMPONENT \ ARRAY NO. | 1 | 2 | 3 | 4 |
|---|---|---|---|---|
| PAPER FEED CLUTCH | 1 | 0 | 0 | 0 |
| PAPER FEED ROLLER | 1 | 1 | 0 | 0 |

FIG. 7B

40'

PREVENTIVE MAINTENANCE WORK ITEMS

| COMPONENT \ ARRAY NO. | 1 | 2 | 3 | 4 |
|---|---|---|---|---|
| | 0~75000 | 75001~125000 | 125001~175000 | 175001~225000 |
| PAPER FEED CLUTCH | CLEANING | LUBRICATION | ADJUSTMENT | REPLACEMENT |
| PAPER FEED ROLLER | CLEANING | CLEANING | REPLACEMENT | < < < < |
| | | | | |

FIG. 7C

FIG. 8

| INDICATION | ITEMS OF WORK |
|---|---|
| REPLACEMENT | REPLACE THE COMPONENT. |
| CLEANING | CLEAN THE COMPONENT. |
| LUBRICATION | LUBRICATE THE COMPONENT. |
| ADJUSTMENT | ADJUST THE COMPONENT. |
| CHECKING | CHECK THE COMPONENT. |
| MAINTENANCE IGNORED | NOT REGARDED AS MAINTENANCE (REPAIR MAINTENANCE). |
| * * * * | NO MAINTENANCE WORK REQUIRED. |
| CHECKING / REPLACEMENT | CHECK THE COMPONENT AND , IF NECESSARY , REPLACE IT. |
| CHECKING / CLEANING | CHECK THE COMPONENT AND , IF NECESSARY , CLEAN IT. |
| CHECKING / LUBRICATION | CHECK THE COMPONENT AND , IF NECESSARY , LUBRICATE IT. |
| CHECKING / ADJUSTMENT | CHECK THE COMPONENT AND , IF NECESSARY , ADJUST IT. |
| CLEANING / LUBRICATION | CLEAN AND LUBRICATE THE COMPONENT. |
| LUBRICATION / ADJUSTMENT | LUBRICATE AND ADJUST THE COMPONENT. |
| < < < < | RETURN TO THE HEAD OF THE MAINTENANCE CYCLE.(NOT AN ITEM OF WORK) |
| > > > > | REPEAT THE LAST(PREVIOUS) WORK. (NOT AN ITEM OF WORK) |

FIG. 10

| STEP | 5 | 10 | 15 | 20 | 25 | 30 | 50 | 55 | END |
|---|---|---|---|---|---|---|---|---|---|
| CURRENT COUNT | 80000 | | | | | | | | |
| n | 1 | | | | | | | | |
| X | | 1 | | 2 | | | | | |
| MAINTENANCE STATE FLAG | | | 1 | | | 1 | | | |
| Z (WORK ITEMS) | | | | | LUBRICATION | | LUBRICATION | | LUBRICATION |

FIG. 11

| STEP | 5 | 10 | 15 | 20 | 25 | 30 | 35 | 40 | 45 | 30 | 50 | 55 | END |
|---|---|---|---|---|---|---|---|---|---|---|---|---|---|
| CURRENT COUNT | 101000 | | | | | | | | | | | | |
| n | 2 | | | | | | | | | | | | |
| X | | 2 | | 3 | | | | 2 | | | | | |
| MAINTENANCE STATE FLAG | | | 1 | | | 0 | | | | 1 | | | |
| Z (WORK ITEMS) | | | | | ADJUSTMENT | | ADJUSTMENT+ ADJUSTMENT | | | | ADJUSTMENT | | ADJUSTMENT |

FIG. 12

| STEP | 5 | 10 | 15 | 30 | 35 | 40 | 45 | 30 | 35 | 40 | 45 | 50 | END |
|---|---|---|---|---|---|---|---|---|---|---|---|---|---|
| CURRENT COUNT | 101000 | | | | | | | | | | | | |
| n | 2 | | | | | | | | | | | | |
| X | | 2 | | | | 1 | | | | 0 | | | |
| MAINTENANCE STATE FLAG | | | 0 | 0 | | | | 0 | | | | | |
| Z (WORK ITEMS) | | | | | LUBRICATION | | | | CLEANING+ LUBRICATION | | | CLEANING+ LUBRICATION | CLEANING+ LUBRICATION |

FIG. 13

| STEP | 5 | 10 | 15 | 30 | 35 | 40 | 45 | 30 | 35 | 40 | 45 | 30 | 35 | 40 | 45 |
|---|---|---|---|---|---|---|---|---|---|---|---|---|---|---|---|
| CURRENT COUNT | 170000 | | | | | | | | | | | | | | |
| n | 3 | | | | | | | | | | | | | | |
| X | | 3 | | | | 2 | | | | 1 | | | | 0 | |
| MAINTENANCE STATE FLAG | | | 0 | 0 | | | | 0 | | | | 0 | | | |
| Z (WORK ITEMS) | | | | | ADJUSTMENT | | | | LUBRICATION+ ADJUSTMENT | | | | CLEANING+ LUBRICATION+ ADJUSTMENT | | |

| STEP | 50 | 55 | END |
|---|---|---|---|
| CURRENT COUNT | | | |
| n | | | |
| X | | | |
| MAINTENANCE STATE FLAG | | | |
| Z (WORK ITEMS) | CLEANING+ LUBRICATION+ ADJUSTMENT | | CLEANING+ LUBRICATION+ ADJUSTMENT |

FIG. 14 Prior Art

COPIER

| ARRAY NO. / COMPONENT | 0 | 1 | 2 | 3 | 4 |
|---|---|---|---|---|---|
| CONTACT GLASS | CLEANING | * * * * | < < < < | | |
| PHOTOSENSITIVE DRUM | * * * * | ADJUSTMENT | * * * * | REPLACEMENT | < < < < |
| UPPER PAPER FEED ROLLER | * * * * | CLEANING | CHECKING / REPLACEMENT | > > > > | |

MAINTENANCE MANAGEMENT SYSTEM FOR IMAGE FORMING EQUIPMENT

BACKGROUND OF THE INVENTION

1. Field of the Invention

The present invention relates to a maintenance management system for image forming equipment, more specifically to a maintenance management system for managing maintenance of image forming equipment such as electronic photocopiers in terms of components that require regular replacement, such as photosensitive drums and paper feeding parts, and components that require regular checking, such as contact glasses.

2. Description of the Prior Art

In general, regular maintenance of image forming equipment such as electronic photocopiers is performed according to service manuals. A service manual lists, for each component of a copier, items of maintenance work that should be performed at every predetermined count of copies (for example, every 100,000 copies) after the replacement of that component. When a predetermined count of copies are supposed to have been produced after the previous regular maintenance occasion, a serviceperson visits a user's site where a copier is installed, and, consulting a service manual for what to do on this occasion of regular maintenance, performs maintenance work according to the service manual.

In a certain copier management system, communications control devices are attached to copiers, and are connected through telephone lines or other to a host computer installed at a maintenance company that manages these copiers. Thus, the host computer collectively manages data concerning maintenance of the image forming equipment. In this system, those devices notify the host computer when to perform regular maintenance at every predetermined count of copies, so that a serviceperson, on receiving such a notification, visits a user's site to perform maintenance work for the copier installed there, just as described above.

FIG. 14 shows a maintenance table as is conventionally stored in such a host computer. As shown in this figure, a maintenance table is a table listing items of maintenance work to be performed for each component in each individual copier. Specifically, in a maintenance table, items of work such as "replacement", "cleaning", "lubrication", "adjustment", and "checking" that need to be performed on the occasions of regular maintenance that take place every predetermined count of copies are listed component by component in order of array numbers that indicate the order of precedence of regular maintenance occasions on which those items of work are performed.

For example, in the case of a contact glass in an original stand, cleaning is performed at the count of 50,000 copies after installation or replacement; at the count of 100,000 copies, no maintenance work is required, but, on completion of the checking at the count of 100,000 copies, the array number is rewound to the initial number, so that cleaning is performed next time at the count of 150,000 copies. On the other hand, in the case of a photosensitive drum, no maintenance work is required at the count of 50,000 copies after installation or replacement; at the count of 100,000 copies, adjustment is performed; at the count of 150,000 copies, no maintenance work is required; on the occasion of the checking at the count of 200,000 copies, replacement is performed, thereby rewinding the array number to the initial number. In the same way, steps of maintenance work for an upper paper feed roller and other components are also defined in the maintenance table, so that the step of maintenance work for each component is advanced one step further on every occasion of regular maintenance.

However, a conventional management system in which maintenance work is performed according to a maintenance table as described above is defective, because it poses a problem when a session of regular maintenance takes place untimely before the completion of one cycle of regular maintenance.

For example, the maintenance cycle of a photosensitive drum shown in FIG. 14 is so determined that replacement is performed on every fourth occasion of checking. Accordingly, if regular maintenance is scheduled to take place every 50,000 copies as described above, it is natural that replacement is performed every 200,000 copies. However, if regular checking is performed every 10,000 copies, and if completion of each checking session is registered in the device attached to a copier as completion of regular maintenance session, the item of maintenance work to be performed next time will be indicated as "replacement" as early as when the third occasion of regular maintenance is completed, that is, at the count of 30,000 copies.

To solve this problem, a conventional copier management system, even while indicating the item of maintenance work to be performed next time as "replacement", also indicates the remaining working life of the photosensitive drum by showing that it is still capable of 170,000 copies and has reached a 15 percent point in its total working life, thereby preventing untimely replacement based solely on the indication of the item of maintenance work to be performed next time. This method, however, is far from sufficiently solving the problem associated with maintenance management based on how many times maintenance has been performed, because a serviceperson may overlook relevant indications or, in some cases, may be compelled to make delicate judgements in consideration of his company's relationship with a user.

The description above seems to suggest that, in order to solve the problem, it is more realistic to determine items of maintenance work to be performed based on the actual count of copies, rather than how many times maintenance has been performed. However, a management method based on the count of copies is also defective, because, when dealing with a component like the contact glass shown in FIG. 14, such a method indicates "cleaning" until the copy count reaches 50,000, but, if the count happens to be 50,001 just when a serviceperson starts maintenance work, it indicates that no maintenance work is required. This problem results from the way threshold values are selected in determining when to perform maintenance, and it often causes, in a conventional maintenance system, losses of information concerning items of maintenance work to be performed.

SUMMARY OF THE INVENTION

An object of the present invention is, in a maintenance management system in which communications control devices attached to electronic copiers are connected through public telephone lines to a host computer at a maintenance company managing those copiers, to make it possible to provide preventive-maintenance-oriented, omission-free instructions for maintenance work, by solving such a system's problems in determining items of maintenance work based on how many times maintenance has been performed or based on the count of copies.

To achieve the above object, according to the present invention, a maintenance management system that manages items of maintenance work to be performed for each component of image forming equipment is provided with a work item storing means, a work item judging means, and a work item determining means. In a communications management system for image forming equipment such as a management system comprising communications control devices for outputting management data and a host computer connected to the communications control devices through a communications network in order to collectively manage the management data, the maintenance management system of the present invention can be constructed as a software program within the host computer.

The work item storing means sets items of maintenance work that should be performed for each component regularly at every predetermined count of use of image forming equipment, and stores different work item setting areas in order of precedence of regular maintenance occasions. The work item storing means is secured, for example, in the work RAM in a host computer. The work item judging means judges, based on an order of precedence of a work item setting area referred to at a particular moment, to which work item setting area belongs an item of work to be performed on a next occasion. The work item determining means determines, based on how many times maintenance has been performed for the image forming equipment until a particular moment, whether or not an item of work that belongs to a work item setting area having an order of precedence prior to a result given by the work item judgment means should be added to an item of work to be performed on a next occasion.

For example, suppose that, in the work item storing means, work item setting areas representing "cleaning", "lubrication", "adjustment" and "replacement" are arranged in this order for a paper feed clutch, which is one component of a copier. On the first occasion of maintenance, even if the work item judging means judges that "lubrication", which is the second in order of precedence, is to be performed on the next occasion of maintenance, the work item determining means determines that "cleaning" is also performed in addition to "lubrication", because, at that moment, "cleaning", which is the first in order of precedence, has not yet been performed.

Further, when the work item judging means judges that a component needs to be replaced, the work item determining means determines that only replacement of the component is performed. This is because, when a component is replaced, cleaning or other items of maintenance work are meaningless.

The work item setting areas in the work item storing means are usually set according to the count of use that corresponds to a regular maintenance cycle, which in turn is determined based on the working lives of components. According to this method, however, it sometimes happens that, for some reason or other, the items of work belonging to the work item setting area of the next order need to be performed before the next occasion of regular maintenance.

To cope with such a situation, preventive maintenance is essential. Therefore, in the present invention, to make it possible to perform preventive maintenance without fail, the items of work that should be performed on a particular occasion are set in the work item setting areas in anticipation.

BRIEF DESCRIPTION OF THE DRAWINGS

This and other objects and features of this invention will become clear from the following description, taken in conjunction with the preferred embodiments with reference to the accompanied drawings in which:

FIGS. 7A to 7C are diagrams showing examples of maintenance work items, maintenance state flags, and preventive maintenance work items;

FIG. 8 is a diagram showing an example of items of work;

FIG. 10 is a diagram showing one management operation procedure;

FIG. 11 is a diagram showing the management operation procedure following the one shown in FIG. 10.

FIG. 12 is a diagram showing another management operation procedure;

FIG. 13 is a diagram showing yet another management operation procedure; and FIG. 14 is a diagram showing an example of conventional maintenance table.

DESCRIPTION OF THE PREFERRED EMBODIMENTS

Figure 1:
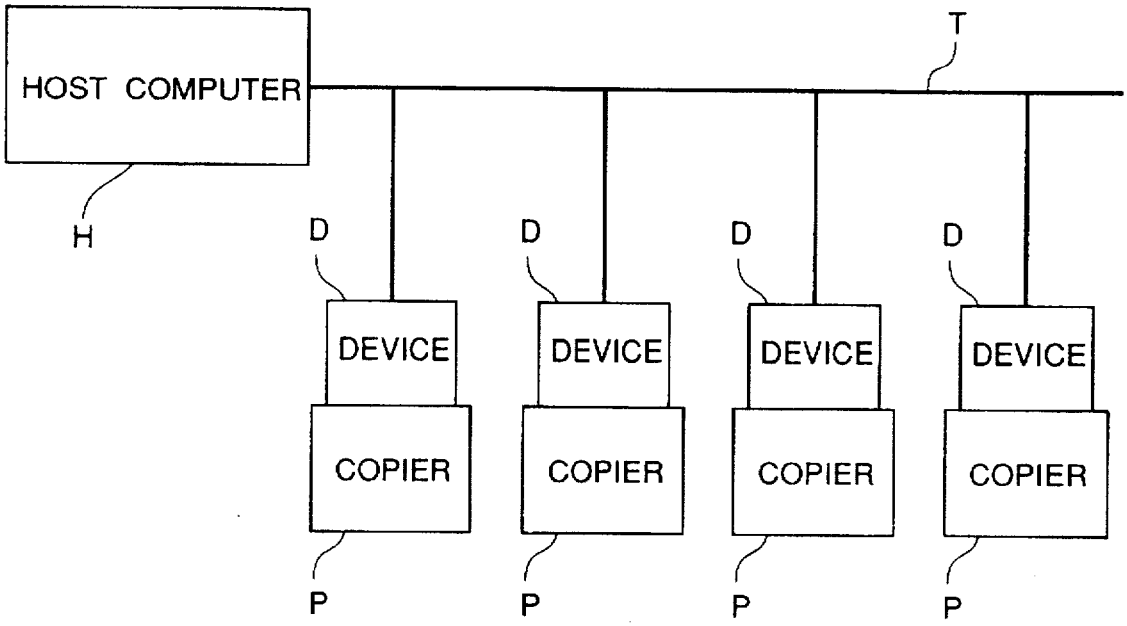
FIG. 1 is a block diagram showing the outline of the management system embodying the present invention.

Hereinafter, an embodiment of the present invention as applied to a copier management system will be described with reference to the drawings. FIG. 1 schematically shows an example of the copier management system. As shown in this figure, the copier management system comprises a host computer H installed at a maintenance company to manage maintenance, and a plurality of copiers P. Each copier P is equipped with a communications control device D, which is connected through a public telephone line T to the host computer H.

Figure 2:
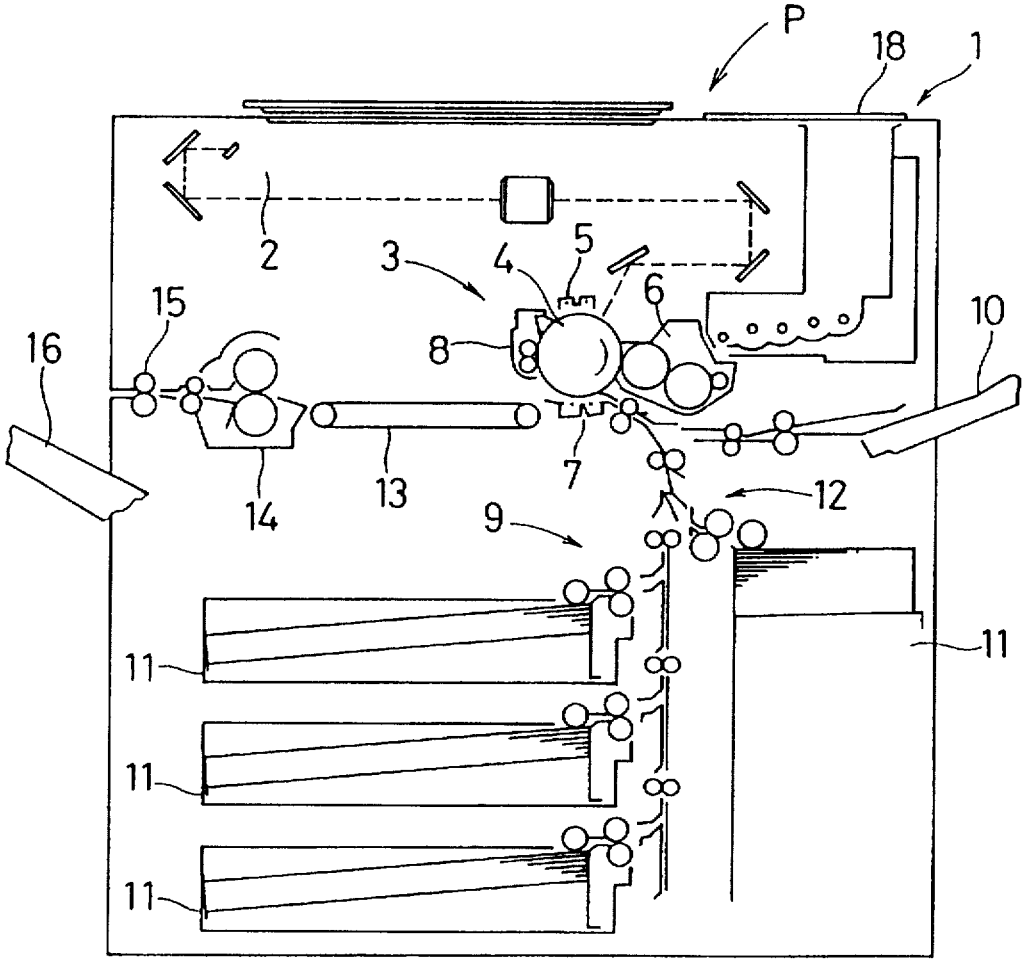
FIG. 2 is a cross-sectional view schematically showing a copier.

FIG. 2 shows the construction of the copier P. As shown in this figure, the copier P is provided with an optical system 2 fitted in the upper part of the body 1. The optical system 2 is for reading an original and comprises a light source, mirrors, lens units, and other components. In the central part of the copier body 1 is provided an image forming section 3 for forming an image with toner based on the read original. The image forming section 3 has a photosensitive drum 4, on the surface of which an electrostatic latent image is formed. Arranged around the photosensitive drum 4 are a main charger 5, a developing unit 6, a separation charger 7, and a cleaning unit 8.

In the lower part of the copier body 1 is provided a paper feed section 9. The paper feed section 9 comprises a bypass table 10 that is disposed in the right-hand part of the copier body 1 shown in FIG. 2, a plurality of paper feed cassettes 11 arranged vertically in the lower part of the copier body 1, and a paper transfer unit 12 for transferring paper sheets stocked in the bypass table 10 or paper feed cassettes 11 to the image forming section 3. Arranged on the downstream side of the image forming section 3 along the paper transfer direction are a paper ejecting conveyor 13 for conveying paper sheets to the left-hand part of the copier shown in FIG. 2, a fixing unit 14 for fixing a toner image on paper by fusion, ejecting rollers 15 for ejecting paper sheets after image fixation, and a ejected-paper tray 16 for stocking ejected paper sheets.

Figure 3:
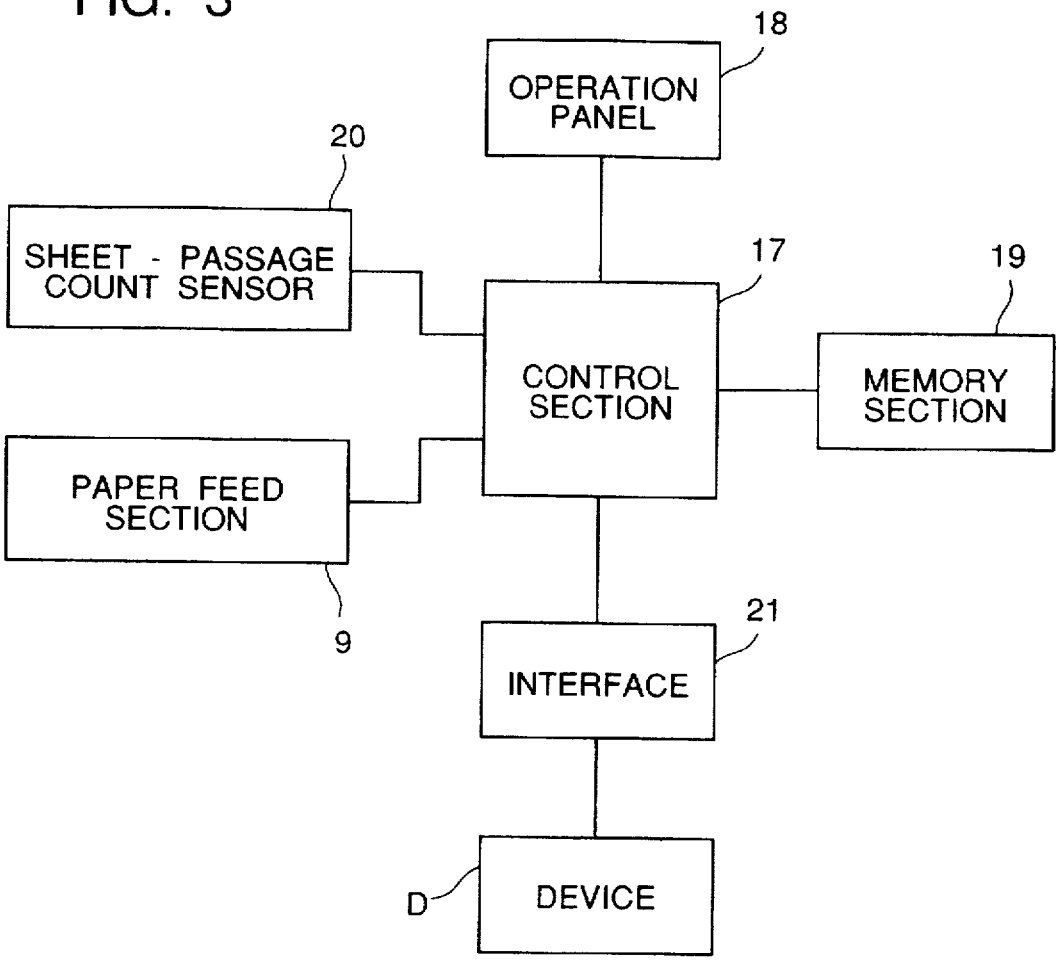
FIG. 3 is a block diagram showing the control system of the copier.

The copier body 1 is further equipped with a control section 17 shown in FIG. 3. The control section 17 is constructed as a microcomputer system including a CPU, a RAM, a ROM, a variety of drivers, and a variety of I/O ports, and an operation panel 18 is connected to it. As shown in FIG. 2, the operation panel 18 is disposed on the upper surface of the copier body 1, and includes an input keypad section and a display section composed of liquid crystal display devices, light emitting diodes, or other.

To the control section 17, a memory section 19 for storing a variety of operation data is also connected. The memory section 19 stores, for example, the total count of copies produced by the copier body 1. Also connected to the control section 17 are a sheet-passage count sensor 20 for counting how many images have been formed, and a paper feed section 9 for feeding paper from paper feed cassettes 11. Actually, a plurality of sheet-passage count sensors 20 are arranged in appropriate positions along the paper feed path from each paper feed cassette 11 through the image forming section 3 and the fixing unit 14 to the ejected-paper tray 16, so that, when a correct passage of a paper sheet is detected, the total count stored in the memory section 19 is incremented. Furthermore, the control section 17 is connected through an interface 21 to the copier management device D, so that the copy count counted by the sheet-passage count sensor 20 is transmitted to that device D.

Figure 4:
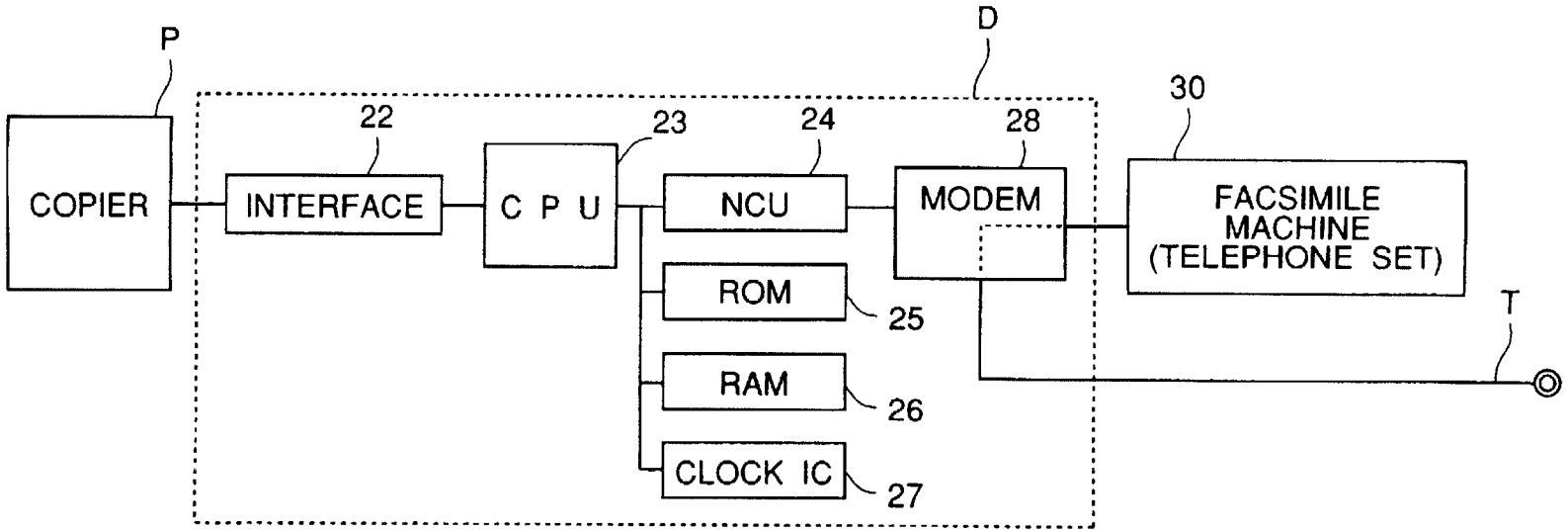
FIG. 4 is a block diagram showing the construction of a communications control device.

The copier management device D, which serves to transmit data required for managing the copier P, is, as shown in FIG. 4, equipped with a serial interface 22, which is connected to the copier body 1. The serial interface 22 is connected to a CPU 23. The CPU 23 is formed as a so-called microcomputer system, and is connected to an NCU (network control unit) 24, a ROM 25, a RAM 26, and a clock IC 27. The NCU 24 is connected to a modem 28, and the modem 28 is in turn connected to a telephone line T.

Note, however, that it is not practical to use the telephone line T exclusively for the device D of the copier. In reality, as shown in FIG. 4, a telephone line for a facsimile machine (or telephone set) 30 is let to pass circuitously through the device D, and the device D is set for transmission only, so that, when a call is received through the telephone line, the device D does not answer the call but transfers it to the facsimile machine or telephone set. Accordingly, in the management system of this embodiment, the host computer H cannot originate a call to the devices D. Alternatively, the management system may be so designed that, by use of a dedicated telephone line, a line switching device, or other means, the host computer H originates a call to read and confirm the current data concerning the copier prior to maintenance.

Figure 5:
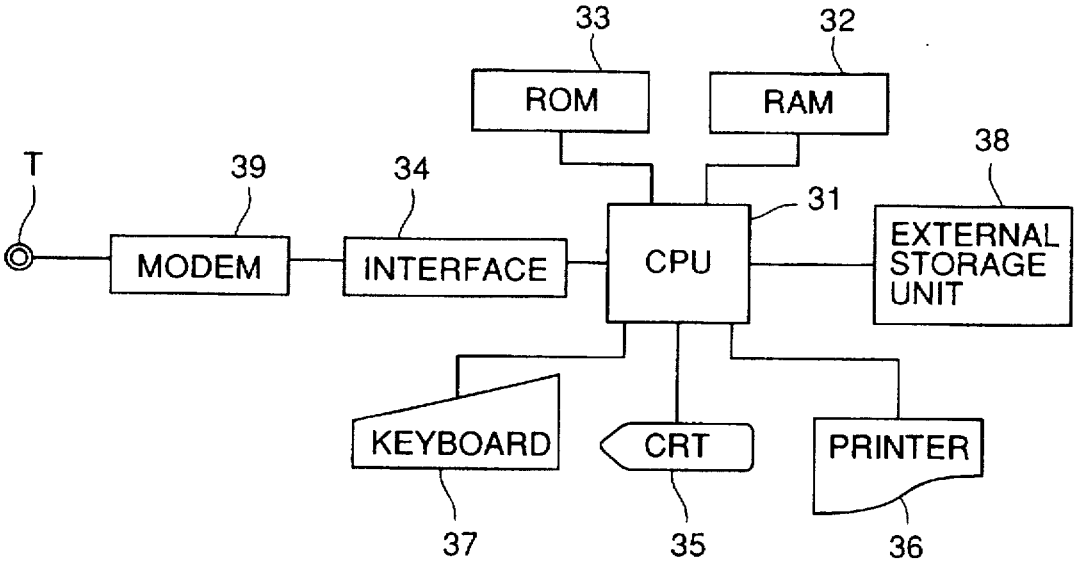
FIG. 5 is a block diagram showing the construction of a host computer.

The host computer receives data transmitted from the devices D, and manages the copiers P collectively based on the data. As shown in FIG. 5, the host computer is provided with a CPU 31, a RAM 32 connected to the CPU 31 and serving as a work item storing means, a ROM 33, and an input/output interface 34. Furthermore, a CRT 35 for display, a printer 36 for printing data, a keyboard 37 for data entry, an external storage unit 38, and others are connected to the CPU 31. The input/output interface 34 is provided with an input/output terminals such as RS-232C, and is connected through a communications modem 39 to a public telephone line.

Figure 6:
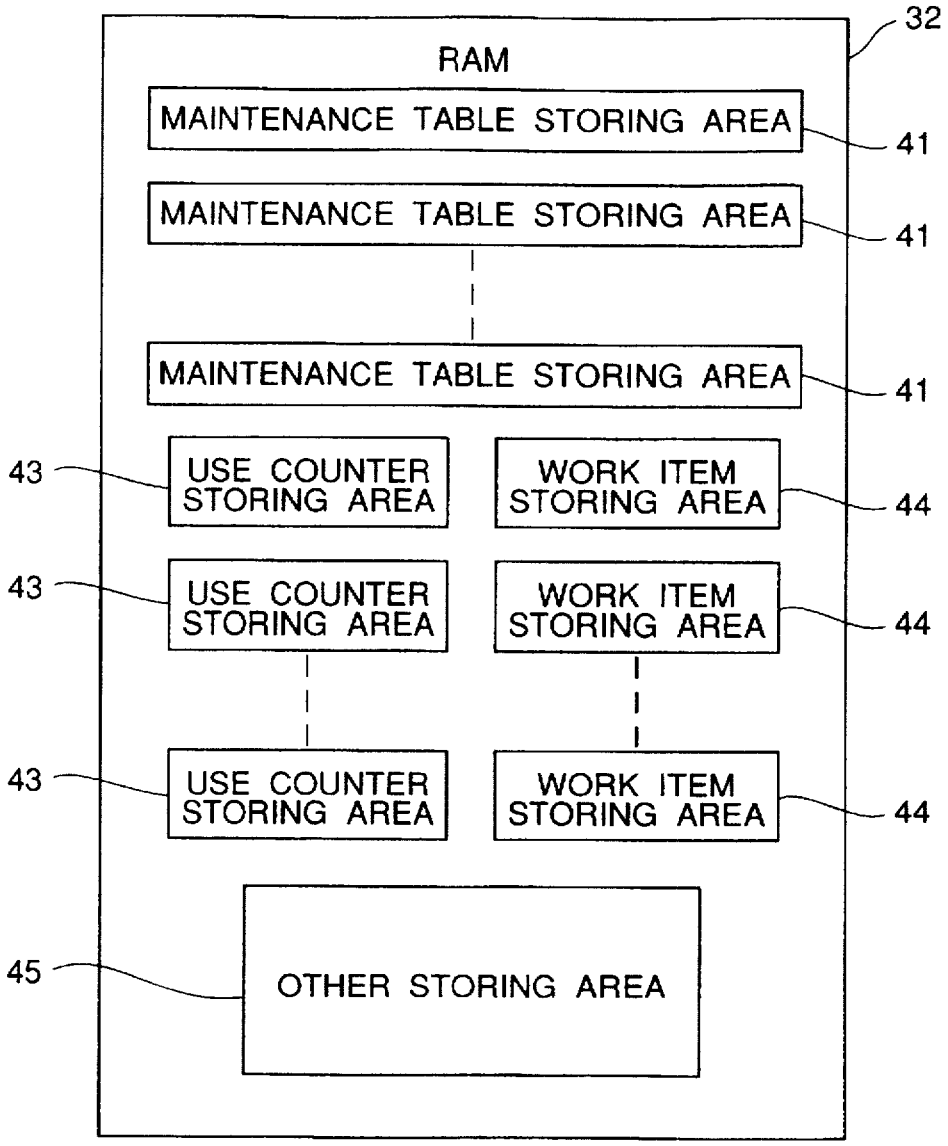
FIG. 6 is a schematic diagram showing the items stored in the RAM of the host computer.

As shown in FIG. 6, in the RAM 32 of the host computer H are provided maintenance table storing areas 41 for storing maintenance tables 40 serving as work item setting areas in which items of regular maintenance work are stored in order of precedence of regular maintenance occasions, use counter storing areas 43 for storing counts of use of components, work item storing areas 44 for storing data representing the items and types of work performed by a serviceperson on the previous maintenance occasion together as well as the array numbers on that occasion and the array numbers specified for the next occasion, and areas 45 for storing other information. These areas are secured separately for each of the copiers P that are connected to the host computer H.

Note that there are three types of maintenance work that a serviceperson performs: "regular maintenance" which is performed regularly at every determined count of copies, "repair maintenance" which is performed to cope with occasional troubles, and "regular and repair maintenance" which means that regular maintenance is performed on the occasion of repair maintenance.

As shown in FIG. 7A, the maintenance table 40 is a table listing items of maintenance work to be performed for each component of each copier P. Specifically, in the maintenance table, items of work that need to be performed on the occasions of regular maintenance that take place every predetermined count of copies are listed component by component in order of array numbers that indicate the order of precedence of regular maintenance occasions on which those items of work are performed. Stored as items of work are, as shown in FIG. 8, items such as "replacement", "cleaning", "lubrication", "adjustment", "checking", and others. Items of maintenance work are displayed on the CRT 35 at a predetermined timing.

Figure 9:
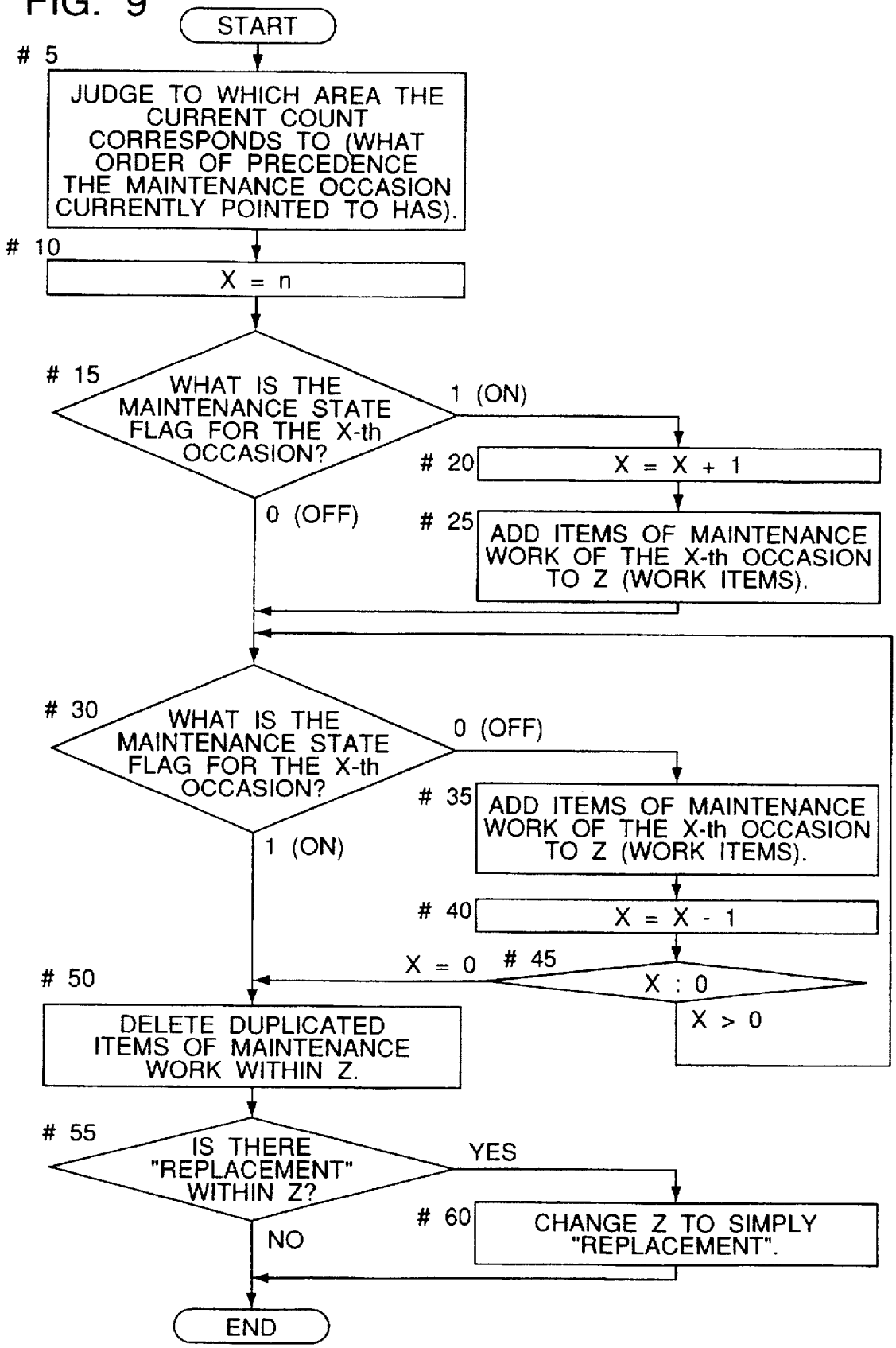
FIG. 9 is a flowchart showing the maintenance management operation of the host computer.

The items of work stored in the above described maintenance table 40 are performed in accordance with the program shown in FIG. 9. To help with judgments that need to be made during the execution of the program, flags indicating states of maintenance are provided, as shown in FIG. 7B. In this figure, "1" represents "ON", and "0" represents "OFF". The program shown in FIG. 9 will be described in detail later.

For example, in the case of a paper feed clutch, an instruction of cleaning is indicated on the first occasion of regular maintenance (at a count of 0 to 50,000 to 100,000 copies) after installation or replacement. If regular maintenance is performed at a count within 50,000 copies, the flag indicating the state of the first occasion of maintenance is turned ON, and the item of the maintenance work to be performed on the next occasion is indicated as "lubrication", according to the maintenance table 40. On the next occasion of maintenance (at a count of 100,001 to 150,000 copies), lubrication is performed. In the same way, at a count of 150,001 to 200,000 copies, adjustment is performed; at a count of 200,001 to 250,000 copies, replacement is performed. In the case of a paper feed roller, at a count of 50,000 to 100,000 copies and 100,001 to 150,000 copies from installation or replacement, cleaning is performed; at a count of 150,001 to 200,000 copies, replacement is performed, thereby rewinding the array number to the initial number. In this way, the steps of maintenance work are defined.

Use counters that indicate the counts of use of components store both the values of the actual use counters and the values of the permitted use counters of each component of a copier P. The permitted use counters are counters that indicate the working lives of each component in counts of copies, and they count the numbers stored in the work item setting areas in order to store predetermined values for each component. On the other hand, the actual use counters hold count values which are to be compared with the values of the permitted use counters. The values of the actual use counters are updated by the value of a total counter that is regularly transmitted from the copier P, the values of three paper feed counters that are provided for each paper feeder, or the values of two optional counters. When a component is replaced, the relevant use counters and maintenance state flags are reset.

The maintenance table 40 shown in FIG. 7A is set according to the count of use that corresponds to a regular maintenance cycle, which in turn is determined based on the working lives of components. For example, regular maintenance is so scheduled that a new regular maintenance cycle is started at every 50,000 copies after a copier is put into service. In this case, it sometimes happens that, for some reason, the items of work belonging to the work item setting area of the next order of precedence need to be performed before the next occasion of regular maintenance.

To cope with such a situation, preventive maintenance is essential. Therefore, to make it possible to perform preventive maintenance, the items of work that should be performed on a particular maintenance occasion are set in anticipation, as exemplified in the maintenance table 401 shown in FIG. 7C, by shifting the count. In this example, the count is shifted 25,000 copies ahead. It is needless to say, however, that how much the count is shifted depends on how earlier the preventive maintenance should be performed.

Next, the maintenance management operation of the host computer H in various situations will be described below, taking the paper feed clutch for example, with reference to the flowchart shown in FIG. 9 and other diagrams shown in FIGS. 10 to 13. FIG. 10 shows the operation in the case where regular maintenance is performed for the first time at the count of 40,000 copies, and for the second time at the count of 80,000 copies. In this case, the use count is at present 80,000 copies. Therefore, when the count is judged in step #5 in FIG. 9 as to which work item setting area in the maintenance table 40 it corresponds to, it is judged to correspond to the work item setting area for the first maintenance occasion, indicating "cleaning".

In step #10, the array number X of the work item setting area is recognized as X=1, and, in step #15, the maintenance state flag at the moment is judged. In this case, the flag remains ON until the second maintenance occasion. Therefore, proceeding to step #20, the array number X of the work item setting area is updated once, and then, in step #25, an instruction corresponding to X=2, that is, an instruction of "lubrication", which is the item of work for the second maintenance occasion, is indicated. In this way, since the current count is 80,000 copies (within the scope of the first maintenance occasion), an instruction corresponding to the next area, that is, an instruction of "lubrication" is indicated.

In step #30, it is confirmed again that the maintenance state flag at the moment is ON, and next, in step #50, the duplicated item in the same work item setting area within the maintenance table 40, that is, the item indicating "lubrication" is deleted. Then, in step #55, it is confirmed whether there is an indication for "replacement", and it is determined that the item of work for the next maintenance occasion is "lubrication".

FIG. 11 shows the operation of the host computer H in a situation where the count has exceeded 100,000 copies and reached 101,000 copies, in the case where regular maintenance is performed for the first time at the count of 40,000 copies, for the second time at the count of 80,000 copies, and so on. In this case, the use count is at present 101,000 copies. Therefore, when the count is judged in step #5 as to which work item setting area in the maintenance table 40 it corresponds to, it is judged to correspond to the work item setting area for the second maintenance occasion, indicating "lubrication".

In step #10, the array number X of the work item setting area is recognized as X=2, and, in step #15, the maintenance state flag at the moment is judged to be ON. Next, proceeding to step #20, the array number X of the work item setting area is updated once, and then, in step #25, an instruction corresponding to X=3, that is, an instruction of "adjustment", which is the item of work for the third maintenance occasion, is indicated. In this way, since the maintenance state flag remains ON until the second maintenance occasion and the current count is in the scope of the second maintenance occasion, the item of work for the next, that is, the third maintenance occasion is indicated as "adjustment".

In step #30, it is confirmed again that the maintenance state flag at the moment is OFF, and then, proceeding to step #35, an instruction of "adjustment" is added to the instruction of "adjustment". Next, in step #40, the array number of the work item setting area is decremented by one to X=2, and, in step #45, the array number X is judged to be greater than zero. Returning to step #30, the maintenance state flag is judged to be ON, and, proceeding to step #50, the duplicated item in the same work item setting area within the maintenance table 40, that is, the item indicating "adjustment" is deleted. Then, in step #55, it is confirmed whether there is an indication for "replacement", and it is determined that the item of work for the next maintenance occasion is "adjustment".

FIG. 12 shows the operation of the host computer in the case where maintenance work is performed after the count has exceeded 100,000 copies and reached 101,000 copies. In this case, the use count is at present 101,000 copies. Therefore, when the count is judged in step #5 as to which work item setting area in the maintenance table 40 it corresponds to, it is judged to correspond to the work item setting area for the second maintenance occasion, indicating "lubrication".

In step #10, the array number X of the work item setting area is recognized as X=2, and, in step #15, the maintenance state flag at the moment is judged to be OFF. Next, proceeding to step #30, the maintenance state flag is again judged to be OFF, and then, in step #35, an instruction of "lubrication", which is the item of work for the second maintenance occasion, is indicated. This is because, although maintenance is performed for the first time, the count corresponds to the work area for the second maintenance occasion, requiring "lubrication".

In this case, however, it is necessary to perform also "cleaning", which is the item of work for the first maintenance occasion. Therefore, in step #40, the array number X of the work item setting area is decremented by one to X=1, and then, in step #45, the array number X is judged to be greater than zero. Returning to step #30, the maintenance state flag is judged to be OFF, and then, proceeding to step #35, an instruction corresponding to X=1, that is, an instruction of "cleaning", which is the item of work for the first maintenance occasion, is added to the instruction of "lubrication".

In step #40, the array number X of the work item setting area is decremented by one to X=0. Therefore, proceeding through step #45 to step #50, the duplicated items in the same work item setting area within the maintenance table 40 are deleted. Then, in step #55, it is confirmed whether there is an indication for "replacement", and it is determined that the items of work for the next maintenance occasion are "adjustment+lubrication". In this way, since the maintenance state flag for the first maintenance occasion is OFF and the current count is in the scope of the second maintenance occasion, the items of work are indicated as "adjustment+lubrication".

FIG. 13 shows the operation of the host computer H in the case where maintenance has not been performed until the count reaches 170,000 copies. In this case, the use count is at present 170,000 copies. Therefore, in step #5, the count is judged to correspond to the work item setting area for the third maintenance occasion, indicating "adjustment". In step #10, the array number X of the work item setting area is recognized as X=3, and next, in steps #15 and #30, the maintenance state flag at the moment is judged to be OFF. Then, in step #35, an instruction of "adjustment" is indicated as the item of work for the third occasion of maintenance.

Next, in step #40, the array number X of the work item setting area is decremented by one to be X=2, and, in step #45, the array number X is judged to be greater than zero. Returning to step #30, the maintenance state flag is judged to be OFF, and, proceeding to step #35, an instruction of "lubrication", which is the item of work for the second maintenance occasion, is added to the instruction of "adjustment".

Further, in step #40, the array number X of the work item setting area is decremented by one to X=1, and then, in step #45, the array number X is judged to be greater than zero. Returning to step #30, the maintenance state flag is judged to be OFF, and then, proceeding to step #35, an instruction of "cleaning", which is the item of work for the first maintenance occasion, is added to the instruction "lubrication+adjustment". In step #40, the array number X of the work item setting area is decremented by one to X=0. Therefore, proceeding through step #45 to step #50, the duplicated items in the same work item setting area within the maintenance table 40 are deleted. Then, in step #55, it is confirmed whether there is an indication for "replacement", and it is determined that the items of work for the next maintenance occasion are "adjustment+lubrication+adjustment". In this way, since the maintenance state flag is OFF from the first maintenance occasion and the current count is in the scope of the third maintenance occasion, the items of work are indicated as "adjustment+lubrication+adjustment".

In a similar manner, if maintenance has not been performed until the count reaches 230,000 copies, the items of work would be indicated as "cleaning+lubrication+adjustment+replacement". In reality, however, maintenance work such as cleaning or other is meaningless when a component is replaced, and therefore the item of work is indicated as just "replacement" when the maintenance work includes replacement. In addition, when a component is replaced, the count of the work item setting area, the count that is compared therewith, and the maintenance state flag are reset, as described earlier.

Note that the present invention can be applied not only to copiers, but also to other types of image forming equipment such as laser printers, facsimile machines, etc. Moreover, types of maintenance and items of work are in reality not confined to any particular types and items mentioned above. Furthermore, the present invention can be applied not only to a system in which communications control devices D attached to copiers and a host computer H are connected through a network, but also to copiers that are installed stand-alone.

As described above, according to the present invention, a maintenance management system for image forming equipment is provided with a work item storing means which sets items of maintenance work that need to be performed for each component regularly at every predetermined count of use of the image forming equipment, and which stores different work item setting areas in order of precedence of regular maintenance occasions. Thus, the maintenance management system judges, based on the order of precedence of the work item setting area referred to at a particular moment, to which work item setting area belongs the items of work to be performed on the next occasion. In addition, the maintenance management system adds, based on how many times maintenance has been performed for the image forming equipment until a particular moment, the items of work that belong to the work item setting area having an order of precedence prior to that of the result given by a work item judgment means to the items of work to be performed on the next occasion, if necessary. Accordingly, the maintenance management system can perform preventive maintenance without fail.

Moreover, the maintenance management system can perform proper maintenance work according to the count of use of the image forming equipment at a particular moment, for example, according to the count of copies produced on a copier. Furthermore, maintenance work can be performed without omission, so that necessary items of maintenance work can be performed without fail. Thus, the present invention solves problems associated with a maintenance management method in which items of maintenance work is determined simply based on how many times maintenance has been performed or based on a count of use of the image forming equipment, in order to make it possible to provide preventive-maintenance-oriented, omission-free instructions for maintenance work.

Obviously, many modifications and variations of the present invention are possible in light of the above teachings. It is therefore to be understood that within the scope of the appended claims, the invention may be practiced other than as specifically described.

What is claimed is:

1. A maintenance management system for image forming equipment for managing items of maintenance work to be performed for each component of the image forming equipment, comprising:

a work item storing means for setting items of maintenance work that need to be performed for each component regularly at every predetermined count of use of the image forming equipment, and for storing different work item setting areas in order of precedence of regular maintenance occasions;

a work item judging means for judging, based on an order of precedence of a work item setting area referred to at a particular moment, to which work item setting area belongs an item of work to be performed on a next occasion; and a work item determining means for determining, based on how many times maintenance has been performed for the image forming equipment until a particular moment, whether or not an item of work that belongs to a work item setting area having an order of precedence prior to a result given by said work item judgment means needs to be added to an item of work to be performed on a next occasion.

2. A maintenance management system for image forming equipment as claimed in claim 1, wherein, when said work item judging means judges that a component needs to be replaced, the work item determining means determines that only replacement of the component be performed.

3. A maintenance management system for image forming equipment as claimed in claim 1, wherein said work item setting areas in said work item storing means are provided in such a way that a work item to be performed at a particular moment is stored in anticipation, in order to make it possible to perform preventive maintenance.

4. A maintenance management system for image forming equipment as claimed in claim 1, wherein a main body of the maintenance management system is constructed as a software program running on a host computer which is connected through a communications network to communications control devices that output management data concerning the image forming equipment and which collectively manages said management data.

* * * * *